US007059111B2

(12) United States Patent
King

(10) Patent No.: US 7,059,111 B2
(45) Date of Patent: Jun. 13, 2006

(54) THRUSTER APPARATUS AND METHOD

(75) Inventor: Lyon Brad King, Calumet, MI (US)

(73) Assignee: Michigan Technological University, Houghton, MI (US)

( * ) Notice: Subject to any disclaimer, the term of this patent is extended or adjusted under 35 U.S.C. 154(b) by 119 days.

(21) Appl. No.: 10/693,127

(22) Filed: Oct. 24, 2003

(65) Prior Publication Data

US 2005/0086926 A1 Apr. 28, 2005

(51) Int. Cl.
*F03H 1/00* (2006.01)

(52) U.S. Cl. ..... 60/202; 60/203.1

(58) Field of Classification Search ..... 60/202, 60/203.1

See application file for complete search history.

(56) References Cited

U.S. PATENT DOCUMENTS 3,359,733 A 12/1967 Forbes
3,359,734 A * 12/1967 Ferrie et al. ..... 60/203.1
3,370,198 A * 2/1968 Rogers et al. ..... 60/202
3,538,375 A * 11/1970 Eckhardt ..... 60/202

OTHER PUBLICATIONS

Jankovsky, R., Tverdokhlebov, S., and Manzella, D., "High Power Hall Thrusters," AIAA Paper No. AIAA-99-2949, Proc. of 35th Joint Propulsion Conference, Jun. 20-23, 1999, Los Angeles, CA. Published prior to Oct. 24, 2002.

Tverdokhlebov, O.S., and Semenkin, A. V., "Iodine propellant for electric propulsion—To be -or not to be," AIAA-2001-3350, 37th AIAA/ASME/SAE/ASEE Joint Propulsion Conference Pasadena, CA. Published prior to Oct. 24, 2002.

Dressler, R.A., Chiu, Y. -H., and Levandier, D.J., "Propellant alternatives for ion and Hall effect thrusters," AIAA-2000-0602, 38th Aerospace Sciences Meeting, Jan. 10-13, 2000, Reno, NV. Published prior to Oct. 24, 2002.

Tverdokhlebov, O.S., Semenkin, A., and Polk, J., "Bismuth propellant option for very high power TAL thruster," AIAA-2002-0348, 40th Aerospace Sciences Meeting, Reno, NV. Published prior to Oct. 24, 2002.

(Continued)

*Primary Examiner*—Ted Kim
(74) *Attorney, Agent, or Firm*—Michael Best & Friedrich

(57) ABSTRACT

A thruster for use with an external power supply. The thruster includes a propellant that exists in a non-gaseous state at standard temperature and pressure and has a melting point $T_m$, a boiling point $T_b$, and an evaporation rate. The thruster further includes a reservoir adapted to house the propellant and selectively heated to a temperature greater than $T_m$ and less than $T_b$, and a power control mechanism positioned to control the amount of power from the external power supply being deposited into the reservoir to control the evaporation rate of the propellant.

30 Claims, 8 Drawing Sheets

OTHER PUBLICATIONS

Choueiri, E. Y., Chiravalie, V., Miller, G.E., Anderson, W., and Bland, J., "Lorentz force accelerator with an open-ended lithium heat pipe," AIAA-96-2737. Published prior to Oct. 24, 2002.

Emsellem, G., Kodys, A.D., and Choueiri, E.Y., "Thermal analysis of a Lorentz force accelerator with an open lithium heat pipe," IEPC-99-166. Published prior to Oct. 24, 2002.

Khartov, S., Serovaisky, V., Smakhtin, A., Tchuyan, R., and Valentian, D., "The investigation of the temperature field in the SPT structure elements," IEPC-95- 174, Proc. of—1995 International Electric Propulsion Conference. Published prior to Oct. 24, 2002.

Butler, G.W., Yuen, J.L., Tverdokhlebov, S.0., Semenkin, A. V., and Jankovsky, R.S., "Multimode, high specific impulse Hall thruster technology," AIAA-2000-3254, 36th AIAA/ASME/SAE/ASEE Joint Propulsion Conference, Huntsville, AL, Jul. 17-19, 2000. Published prior to Oct. 24, 2002.

Pote, B. and Tedrake, R., "Performance of a high specific impulse Hall thruster," IEPC-01- 035, Proceedings of 27th International Electric Propulsion Conference, Pasadena, CA, Oct. 15-19, 2001. Published prior to Oct. 24, 2002.

Raitses, Y., Doff, L.A., Litvak, A.A., and Fisch, N.J., "Plume reduction in segmented electrode Hall thruster," Journal of Applied Physics, vol. 88, No. 3, Aug. 2000, pp. 1263-1270. Published prior to Oct. 24, 2002.

Raitses, Y., Staack, D., and Fisch, N.J., "Plasma Characterization of Hall Thruster with Active and Passive Segmented Electrodes," PPPL-3746 UC-70, Sep. 2002, Princeton, NJ. Prepared for the U.S. Dept. of Energy.

Kerslake, W. R. and Ignaczak, L.R., "Development and Flight History of SERT II Spacecraft, " Prepares for the AIAA/SAE/ASME/ASEE 28th Joint Propulsion Conference and Exhibit, Jul. 6-8, 1992, Nashville, TN, PP. 1-50

Trofimov, A.V., "Hall Accelarator with Cadmium Vapor," Sov. Phys. Tech. Phys. 22(10), Oct. 1977, pp. 1280-1281.

Gnedenko, V.G., Petrosov, V.A., and Trofinov, A.V., "Prospects for Using Metals as Propellant in Stationary Plasma Engines od Hall-Type," IEPC Proceedingd of the 24th International Electric Propulsion Conference, Moscow, Russia, Sep., 1995, vol. 1, pp. 399-403.

Mayer, R.X., "Laboratory Testing of the Space-Charge-Sheath Electric Thruster Concept, " J. Spacecraft 7(3), Mar. 1970, pp.251-255, accompanied by a Statement of Relevance.

Mayer, R.X., "Laboratory Testing of the Space-Charge-Sheath Electric Thruster Concept," Paper No. 69-282 at the AIAA 7th Electric Propulsion Conference, Williamsburg, VA., Mar. 3-5, 1969, pp. 1-6.

Mayer, R.X., "A Space-Charged-Sheath Electric Thruster," AIAA Journal 5(11), Nov. 1967, pp. 2057-2059; presented as Paper 66-627 at the AIAA Third Annual Meeting, Boston, Mass., Nov. 29 - Dec. 2, 1966.

* cited by examiner

THRUSTER APPARATUS AND METHOD

STATEMENT REGARDING FEDERALLY SPONSORED RESEARCH OR DEVELOPMENT

This invention was made with United States Government support under federal Grant No. F49620-03-1-0027 awarded by the United States Air Force, Air Force Research Labs. The United States Government has certain rights in this invention.

BACKGROUND OF THE INVENTION

The present invention relates to thrusters, particularly Hall-effect thrusters, and more particularly to Hall-effect thrusters employing a condensable propellant. Existing thrusters include anodes that are used to supply a gaseous propellant (e.g., xenon) to the plasma discharge of the thruster. The mass flow rate of the gaseous propellant is controlled upstream of the anode by a dedicated control system. Such thrusters are typically mid-power thrusters operating in the 1-kW regime, with a specific impulse of approximately 1500 sec, an efficiency of approximately 50%, approximately 50 mN of thrust, and used mainly in north-south-stationkeeping (NSSK) of geostationary communications satellites. High-power thrusters (e.g., operating at power levels greater than 30 kW) are being developed to extend electric propulsion systems to more diverse applications. Scaling existing mid-power thrusters to larger powers is physically straightforward but is impeded by financial considerations, partly due to low efficiencies.

Condensable metal propellants have recently been found to have performance improvements over gaseous propellants, such as xenon. Existing thrusters employing a metal propellant (e.g., lithium) and a metal vapor supply anode distribute gaseous metal vapors that are created upstream of the anode in a separate boiling tank. As a result, the existing metal vapor supply anodes must be maintained at a temperature higher than the metal boiling temperature to prevent condensation of the metal propellant within the anode, which usually requires the use of auxiliary electric power to heat the solid propellant. Significant power losses and low efficiencies occur as heat radiates from the anode as a result of maintaining the anode at such high temperatures. Therefore, a thruster that minimizes power losses due to heating of the anode and improves control of the evaporation rate of the propellant is desirable.

SUMMARY OF THE INVENTION

In one aspect, the present invention provides a thruster for use with an external power supply comprising a propellant that exists in a non-gaseous state at standard temperature and pressure, the propellant having a melting point $T_m$, a boiling point $T_b$, and an evaporation rate. In addition, the thruster comprises a reservoir adapted to house the propellant, the reservoir selectively heated to a temperature greater than $T_m$ and less than $T_b$. The thruster further comprises a power control mechanism positioned to control the amount of power from the external power supply being deposited into the reservoir to control the evaporation rate of the propellant.

In another aspect, the present invention provides a thruster comprising a propellant that exists in a non-gaseous state at standard temperature and pressure, an anode having a temperature and adapted to house the propellant in a liquid state, at least one passage in an outer wall of the anode to allow propellant vapors to diffuse outwardly of the anode at a propellant supply rate, an electron source positioned to ionize diffused propellant vapors, and at least one electrode positioned downstream of the anode to attract a fraction of electrons from the electron source and divert the electrons to control at least one of the temperature of the anode and the propellant supply rate.

In yet another aspect, the present invention provides a method for producing a thrust in a thruster having an external power supply, the method comprising providing a propellant that exists in a non-gaseous state at standard temperature and pressure and has a melting temperature $T_m$ and a boiling temperature $T_b$ and an evaporation rate. The method further includes providing a reservoir to house the propellant, selectively heating the reservoir to a temperature greater than $T_m$ and less than $T_b$, vaporizing the propellant to form propellant vapors at an evaporation rate, and controlling the amount of power from the external power supply that is deposited into the reservoir to control the evaporation rate of the propellant.

Other features and aspects of the invention will become apparent to those skilled in the art upon review of the following detailed description, claims, and drawings.

Figure 1:
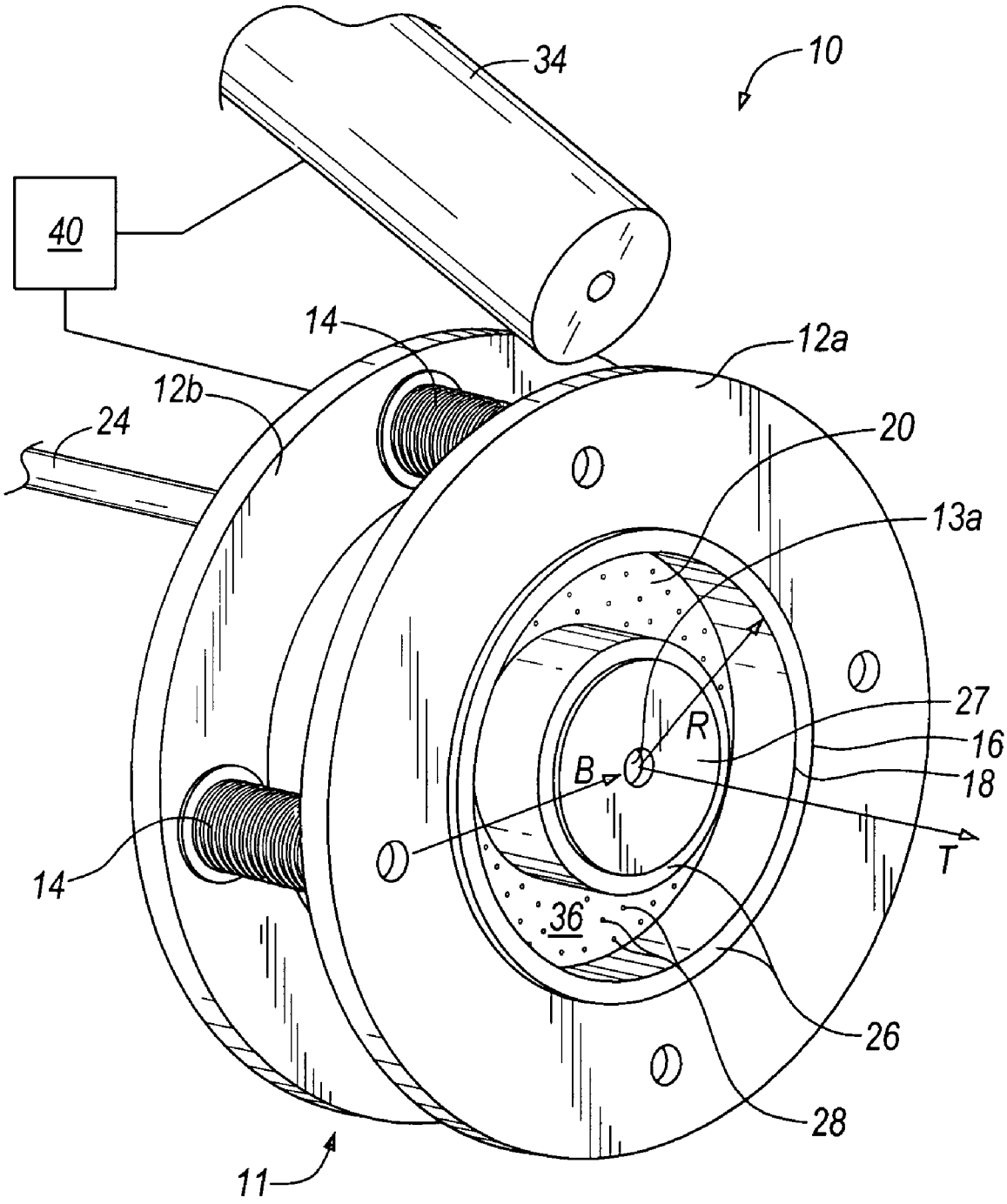
FIG. 1 is an isometric view of a thruster according to one embodiment of the present invention.

Before one embodiment of the invention is explained in detail, it is to be understood that the invention is not limited in its application to the details of construction and the arrangements of the components set forth in the following description or illustrated in the drawings. The invention is capable of other embodiments and of being practiced or being carried out in various ways. Also, it is understood that the phraseology and terminology used herein is for the purpose of description and should not be regarded as limiting. The use of "including" and "comprising" and variations thereof herein is meant to encompass the items listed thereafter and equivalents thereof as well as additional items.

DETAILED DESCRIPTION

The present invention relates to thrusters that employ a condensable propellant and operate at high efficiencies. The focus of the description below will be on Hall-effect thrusters. However, it should be noted that the present invention can be extended to other types of electric propulsion thrusters without departing from the spirit and scope of the present invention. That is, the present invention can be extended to a variety of thrusters that use electrical energy to heat and/or directly eject propellant, including electron bombardment thrusters, ion thrusters, arcjets, pulsed plasma thrusters, resistojets, magnetoplasmadynamic thrusters, contact ion thrusters, pulsed induction thrusters and Lorentz force accelerators (LFAs). Various aspects of the present invention have been described in proposals submitted by Lyon B. King, Ph.D., Department of Mechanical Engineering-Engineering Mechanics, Michigan Technological University to the Air Force Office of Scientific Research on May 14, 2002, and the Defense University Research Instrumentation Program on Aug. 20, 2002, entitled "A Vaporizing Liquid-metal Anode for High-power Hall Thrusters" and "A Ground-Test Facility for High-Power Electric Thrusters operating on Condensable Propellants," respectively, both of which are incorporated herein by reference.

As used herein and in the appended claims, the term "plasma" or "plasma discharge" refers to a fluid of ions and free electrons.

As used herein and in the appended claims, the terms "upstream" and "downstream" refer to the direction of propellant movement in a thruster. That is, the term "upstream" is used to describe any location, element or process that occurs prior to the point or area being referred to relative to the direction of propellant movement in a thruster, whereas the term "downstream" is used to describe any location, element or process that occurs subsequent to the point or area of reference with respect to propellant movement in the thruster.

As used herein and in the appended claims, the term "Hall-effect thruster" or "Hall thruster" refers to a rocket engine that uses a magnetic field to accelerate a plasma and so produce a thrust. For example, in a thruster having a radial direction and an axial direction, a radial magnetic field is set up between concentric annular magnetic poles. Space between the magnetic poles can be filled with a propellant gas through which a continuous electric discharge passes between two electrodes. A positive electrode, an anode, can be located generally upstream, and a negative electrode, a cathode, located generally downstream of the magnetic poles, thereby establishing an axial electric field. The axial electric field interacts with the radial magnetic field to produce, by the Hall effect, a current in the azimuthal direction. This current reacts against the magnetic field to generate a force on the propellant in the downstream axial direction.

As used herein and in the appended claims, the term "ionization potential" or "IP" refers to the energy required to remove an electron from an atom, molecule or radical.

As used herein and in the appended claims, the term "heat of vaporization" refers to the heat absorbed by a unit mass of a material at its boiling point in order to convert the material into a gas at the same temperature and at constant pressure.

As used herein and in the appended claims, the term "vapor pressure" refers to the pressure exerted by a vapor, and is often understood to mean saturated vapor pressure (i.e., the vapor pressure of a vapor in contact with its liquid form). The vapor pressure of a vapor is temperature dependent.

As used herein and in the appended claims, the term "thrust" refers to the propulsive force delivered by a propulsion system or thruster. Thrust is usually expressed in terms of Newtons (N). Thrust depends on the atmospheric pressure at a certain altitude, so thrust values are usually given either under vacuum conditions or at sea level.

As used herein and in the appended claims, the term "specific impulse" ($I_{sp}$) refers to the total impulse that the thruster generates per unit of propellant weight, expressed in seconds (s). The higher the specific impulse, the less propellant the thruster uses to generate a certain total impulse. The term "total impulse" refers to a change in momentum that can be accomplished by a thruster, expressed in Newton-seconds (Ns).

Figure 2:
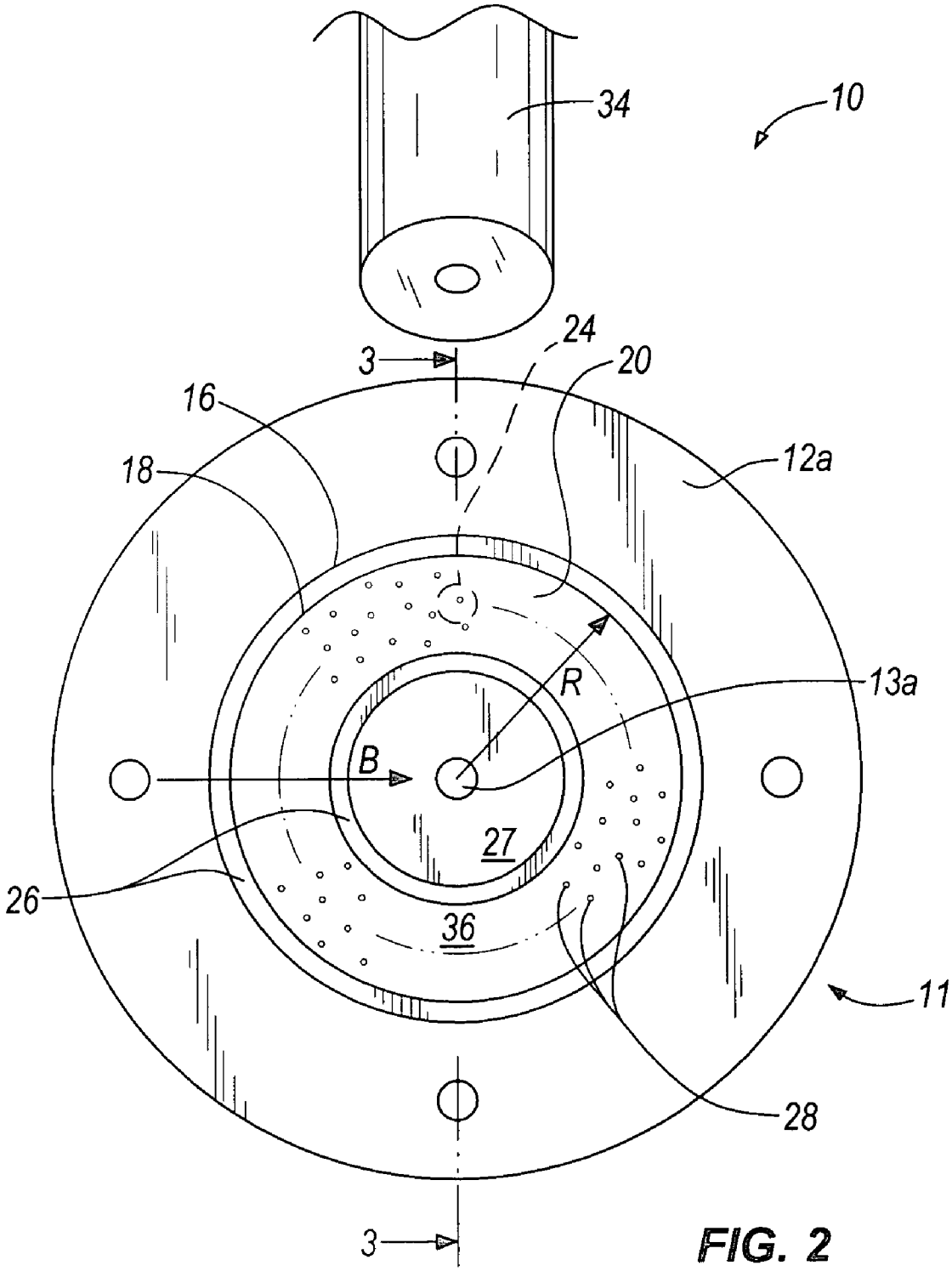
FIG. 2 is a plan view of the thruster of FIG. 1.
Figure 3:
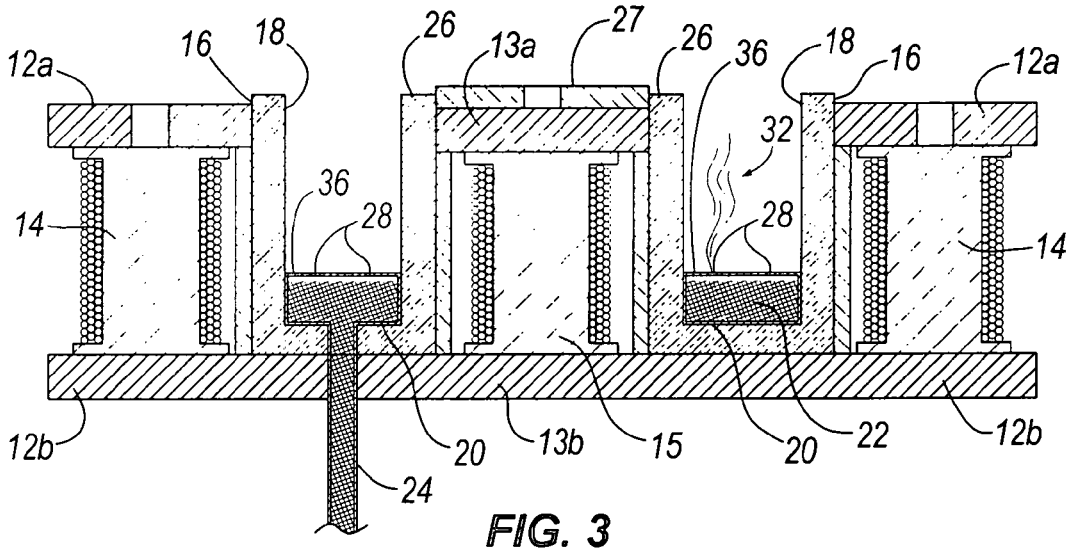
FIG. 3 is a cross-sectional view of the thruster of FIGS. 1 and 2 taken along line 3—3.

FIGS. 1–4 illustrate one embodiment of a thruster 10 according to the present invention. The thruster 10 includes a generally cylindrical body 11 having an axial direction, as generally indicated by arrow T, and a radial direction, as generally indicated by arrow R. The thruster 10 includes a magnetic circuit formed by front and rear outer magnetic poles 12*a* and 12*b* and outer wire-wound bobbins 14, and front and rear inner magnetic poles 13*a* and 13*b*, and inner wire-wound bobbin 15 (inner magnetic poles 13*a,b* and inner wire-wound bobbin 15 best illustrated in FIG. 3). The front outer magnetic pole 12*a* and wire-wound bobbins 14 form a generally annular shape that is concentric with the front inner magnetic pole 13*a* and wire-wound bobbin 15. In some embodiments, such as the illustrated embodiment, the rear outer magnetic pole 12*b* can be generally disc-shaped and therefore, one disc can serve as both the rear outer magnetic pole 12*b* and the rear inner magnet pole 13*b*, as shown in FIG. 3. The front outer magnetic pole 12*a* and wire-wound bobbins 14 are separated from the front inner magnetic pole 13*a* and wire-wound bobbin 15 by an annular space 16, such that a substantially radial magnetic field B is established generally across the annular space 16. The illustrated embodiment depicted in FIGS. 1–4 shows magnetic field B directed radially inward with respect to the thruster 10, but the magnetic field B can instead be directed radially outward, depending on the configuration of the magnetic circuit. The outer and inner magnetic poles 12*a,b* and 13*a,b* can be formed of a variety of magnetic materials, including various forms of iron.

Figure 4:
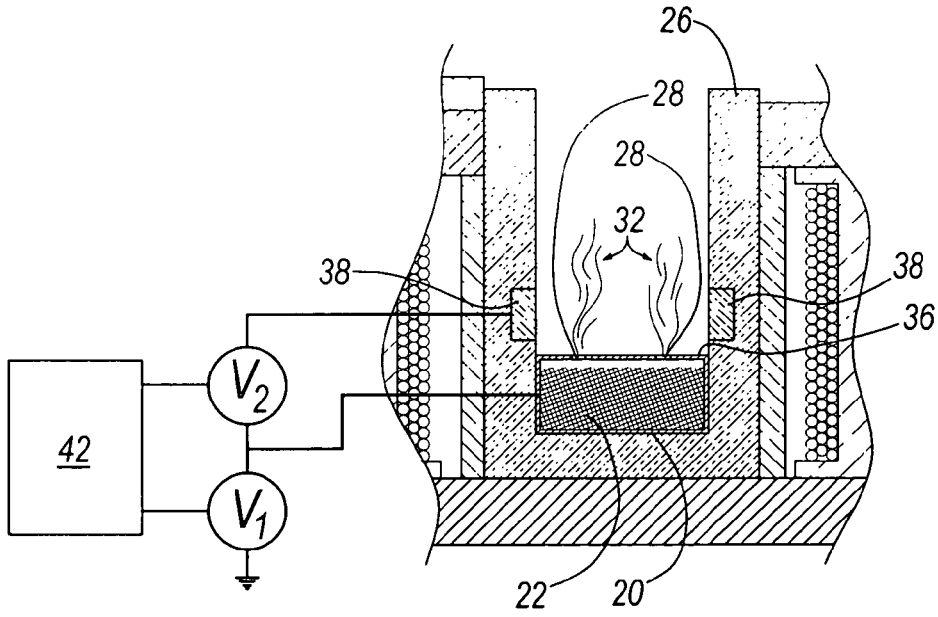
FIG. 4 is a partial cross-sectional view of the thruster of FIGS. 1–3.

A thermal insulator 26 is positioned within the annular space 16. The illustrated embodiment of the thermal insulator 26, as best shown in FIGS. 3 and 4, has an annular shape such that it can fit within the annular space 16, and a generally U-shaped cross-section that further defines an annular space 18. The thermal insulator 26 can be formed of a variety of materials having low thermal conductivity, including various forms of boronitride. An additional thermal insulator 27 may be positioned downstream of the inner magnetic pole 13*a*, thereby substantially covering the inner magnetic pole 13*a*.

A reservoir 20 is positioned within the annular space 18 formed by the thermal insulator 26, as best illustrated in FIGS. 3 and 4. The reservoir 20 houses a propellant 22 for the thruster 10. The propellant 22 can be continuously supplied to the reservoir 20 by a propellant inlet 24, as best shown in FIGS. 1 and 3. The reservoir 20, propellant inlet 24 and any additional plumbing or piping for containing the propellant 22 can be formed of a variety of materials, including without limitation, metal materials with a high melting temperature, such as molybdenum.

The propellant 22 is a condensable material and exists in a non-gaseous state at standard temperature and pressure. The propellant 22 has a melting temperature $T_m$ and a boiling temperature $T_b$ and is maintained at a temperature above $T_m$, particularly at a temperature above $T_m$ and below $T_b$, in the reservoir to ensure that the propellant 22 in the reservoir 20 is in a liquid or molten state. The propellant 22 can comprise at least one of bismuth, mercury, cesium, cadmium, iodine, tin, indium, lithium, germanium, and any other heavy metal having a high molecular weight and a low ionization potential (IP). Table 1 displays various physical properties (i.e., molecular weight, ionization potential, $T_m$, $T_b$, and heat of vaporization) and market prices of a few of the propellants 22 that can be used with the present invention. Specifically, cadmium, iodine and bismuth are shown in Table 1, along with xenon and krypton, which are currently-known gaseous propellants for Hall-effect and ion thrusters.

TABLE 1

Physical properties of gaseous propellants and propellants of the present invention

| Propellant | Molecular Weight (amu) | Ionization Potential (eV) | $T_m$ (K) | $T_b$ (K) | Heat of Vaporization (J/kg) | Market Price ($US/kg) |
|---|---|---|---|---|---|---|
| Xe | 131.29 | 12.13 | N/A | N/A | N/A | 2,224.00 |
| Kr | 83.8 | 13.99 | N/A | N/A | N/A | 295.00 |
| Cd | 112.4 | 8.99 | 594 | 1040 | $8.89 \times 10^5$ | 0.62 |
| I | 126.9 | 10.44 | 386 | 455 | $3.28 \times 10^5$ | 15.00 |
| Bi | 208.98 | 7.287 | 544 | 1837 | $7.23 \times 10^5$ | 8.00 |

The propellant 22 stored in the reservoir 20 in a liquid state is converted to a gaseous state by evaporation of the propellant 22 in the reservoir 20. Passages 28, as best illustrated in FIG. 2, are formed in the reservoir 20 to allow the evaporated propellant 22 to escape the reservoir 20 and flow into the annular space 18, which can also be referred to as the discharge chamber 18. Therefore, from this point forward, the propellant 22 in the reservoir 20 will be assumed to be liquid, and the propellant in the annular space 18 will be assumed to be gaseous and will be referred to as propellant vapors 32.

The reservoir 20 further comprises a positive electrode, that is, the reservoir 20 serves the dual purpose of housing the propellant 22 and serving as the anode in an electric circuit. Therefore, the reservoir 20 will be referred to as the anode/reservoir 20 from this point forward. A cathode 34 is positioned generally laterally to the thruster body 11 and emits a shower of electrons to a region downstream of the front magnetic poles 12*a* and 13*a*. An electric field E is established between the anode/reservoir 20 and the cathode 34 that can perform work on ions and free electrons flowing in the thruster 10. A current of electrons (either emitted from the cathode 34 or removed from propellant vapor atoms, as explained below) are driven generally upstream in the thruster 10 in the presence of the electric field E toward the anode/reservoir 20. Therefore, the electrons are referred to herein as "backstreaming electrons." The electrons thus bombard the propellant vapors 32 as the propellant vapors 32 escape the passages 28 of the anode/reservoir 20, thereby ionizing the propellant vapors 32. As an electron collides with a propellant vapor atom, an outer electron from the propellant vapor atom is removed (provided the energy of the collision is equal to or greater than the ionization potential of the propellant), creating a plasma of positively-charged propellant ions and free electrons in the discharge chamber 18. Therefore, the amount of free electrons increases as propellant vapors 32 are ionized and is directly proportional to the amount of positively-charged propellant ions.

The plasma can provide some power input to heat the anode/reservoir, mainly through the backstreaming electrons depositing their kinetic energy to the anode/reservoir 20 through impact (such power input sometimes referred to herein as "waste heat"). Although the exact amount of the power supplied from the plasma to the anode/reservoir 20 will vary, it has been estimated that approximately 20% of the total thruster input power can be deposited into the anode/reservoir, thus establishing an anode/reservoir power deposition rate of 20%. However, other anode/reservoir power deposition rates are possible and within the spirit and scope of the present invention. The total thruster input power may be supplied by any of a variety of external power supplies commonly-known to those of skill in the art, including without limitation, at least one of a battery, a generator, a nuclear reactor, a radioisotope thermoelectric generator (RTG), a fuel cell, a solar cell, combinations thereof, and any other power supply capable of providing electrical power. Particularly useful in providing power to thrusters is a combination of one or more solar cells, a battery and power processing electronics for conditioning the electrical power provided to the thruster.

The passages 28 must be sized according to the vapor pressure of the propellant 22, the required performance of the thruster, and the energy input to the anode/reservoir 20 from both an external power supply and waste heat from the plasma. The performance of the thruster can refer to performance parameters such as specific impulse, power and thrust. Energy input to the anode/reservoir 20 increases the anode/reservoir temperature, which in turn increases the evaporation rate of the propellant 22, which in turn increases the rate at which the propellant 22 escapes the passages 28, the propellant supply rate (which can be measured in terms of mass flow rate). The passages 28 have a total vapor escape area, which can be estimated using the design calculations presented in Example 1. From the total vapor escape area, it is possible to predict the fraction of the anode/reservoir face area that must be open, or the open-area fraction, to permit adequate propellant diffusion for a given thruster power. Design calculations used to predict the open-area fraction are also presented in Example 1. The open-area fraction can be achieved in a variety of ways, including without limitation, drilling small holes in a downstream-directed face 36 of the anode/reservoir 20, by machining azimuthal or radial channels in the anode/reservoir 20, or by creating apertures in the anode/reservoir 20 in any other manner known to those of ordinary skill in the art.

The thruster 10 described thus far has a fixed vapor escape area defined by the passages 28 and represents an unstable system. That is, if the anode/reservoir power deposition rate exceeds the 20% assumed in the analysis (see Example 1), the equilibrium anode/reservoir temperature will increase and, as a result, the propellant supply rate will increase. The increase in propellant supply rate will cause an overall increase in thruster power, which will further amplify the increase in anode/reservoir temperature ad infinitum. The sensitivity of the thruster and propellant supply system described in Example 1 is explored and estimated in Example 2.

The present invention exploits the sensitivity of the propellant supply system to achieve control of the propellant supply rate. Referring to FIG. 4, the thruster 10 of the present invention further includes at least one electrode 38 positioned downstream of the anode/reservoir 20. The at least one electrode 38 and the anode/reservoir 20 together form a power-sharing segmented anode adapted to actively control the power deposition into the anode/reservoir 20 and, hence, the propellant supply rate, without requiring the use of any external heaters to heat the anode/reservoir 20.

The thruster 10 uses a power control mechanism that includes two annular electrodes 38. Each electrode 38 of the illustrated embodiment is embedded in a wall of the thermal insulator 26 and physically separated by the annular space 18. The electrodes 38 are also physically separated from the anode/reservoir 20 and substantially thermally isolated from the anode/reservoir 20 by the thermal insulator 26. The electrodes 38 have a positive charge and therefore form a power-sharing segmented anode with the anode/reservoir 20, as mentioned above. A fraction of the backstreaming electrons can be attracted to the electrodes 38 and therefore diverted from the anode/reservoir 20 to the electrodes 38 and back into the electric circuit of the thruster 10. This avoids overheating of the anode/reservoir 20. However, by applying a controllable voltage differential between the electrodes 38 and the anode/reservoir 20, a fraction of the energy from the backstreaming electrons can be directed from the electrodes 38 to the anode/reservoir 20, as needed, to maintain the temperature of the anode/reservoir 20 at a temperature greater than $T_m$ of the propellant 22 and precisely control the propellant supply rate. The power control mechanism can further include a computerized control system 42 to monitor the anode/reservoir temperature in real-time and alter the voltage differential between the electrodes 38 and the anode/reservoir 20 to precisely control the anode/reservoir power deposition rate and, in turn, the anode/reservoir temperature and propellant supply rate. The computerized control system 42 can also alter, in real-time, the potential drop between the cathode 34 and the anode/reservoir 20. Therefore, an initial energy input mechanism (also commonly referred to as a "hot-start mechanism") can be used to heat the anode/reservoir 20 to a temperature above $T_m$ and below $T_b$ so that the propellant 22 can be vaporized and produce propellant vapors 32. Once a steady state production of propellant vapors 32 has been achieved, the anode/reservoir temperature can be maintained within a desired range by controlling the amount of thruster power that is deposited into the anode/reservoir 20 using the power control mechanism described above. The initial energy input mechanism can include one or more electric heaters powered from the same external power supply 40 as the thruster 10 or a different power supply to heat the anode/reservoir 20 and begin supplying propellant vapors 32 to the discharge chamber 18. Alternatively, the initial energy input mechanism can include a system that provides xenon, or another gaseous propellant, to the thruster 10 until the anode/reservoir 20 has been heated to a temperature to supply propellant vapors 32 to the discharge chamber 18 (at steady-state or otherwise). Other initial energy input mechanisms are possible and included within the spirit and scope of the present invention.

EXAMPLE 1

A critical design parameter of the propellant supply system according to the present invention is the vapor escape area of the anode/reservoir 20. If the passages 28 through which the propellant vapors 32 diffuse to the discharge chamber 18 are improperly sized, the propellant mass flow rate will be incorrect. Design calculations presented below govern the proper escape area for an example thruster design. For simplicity, the anode/reservoir of the exemplary embodiment is referred to as only the anode in this example.

Hall thruster performance in this example is defined by input power, $P_T$, specific impulse, $I_{sp}$, and efficiency, $\eta$. These performance parameters are related to propellant supply rate, $\dot{m}$, according to $$\dot{m} = \frac{2\eta P_T}{g^2 I_{sp}^2}, \qquad \text{Eqn. 1}$$

where g is the acceleration due to gravity at Earth's surface. In addition to performance characteristics, thruster physical geometry can be calculated according to design correlations. It is possible to derive a relation for the thruster anode area as a function of thruster power, $A=A(P_T)$. From these data, the equilibrium anode temperature, $T_{anode}$ can be estimated.

The power deposited into the anode will be dissipated through radiation from the area, A, of the anode downstream-directed face 36 and conduction through surfaces of the anode in contact with the thruster body according to $$0.2P_T=\sigma\epsilon A T_{anode}^4+xP_T \qquad \text{Eqn. 2}$$

where x denotes the fraction of thruster power which is dissipated from the anode through conduction to the body. In a study done with an SPT-100 running on xenon ($P_T$=1.35 kW), the anode temperature was measured to be 1,000 K. Using this study as a data point and assuming an emissivity of 0.6, Eqn. 2 can be solved for x to estimate that 13% of the thruster power is dissipated through conduction from the anode to a remainder of the thruster 10, while 7% of the thruster power is radiated away from the anode face area, A. While the above study represents only a single datum, it is reasonable to assume that the power balance will be similar in thrusters with similar scaling.

Figure 5:
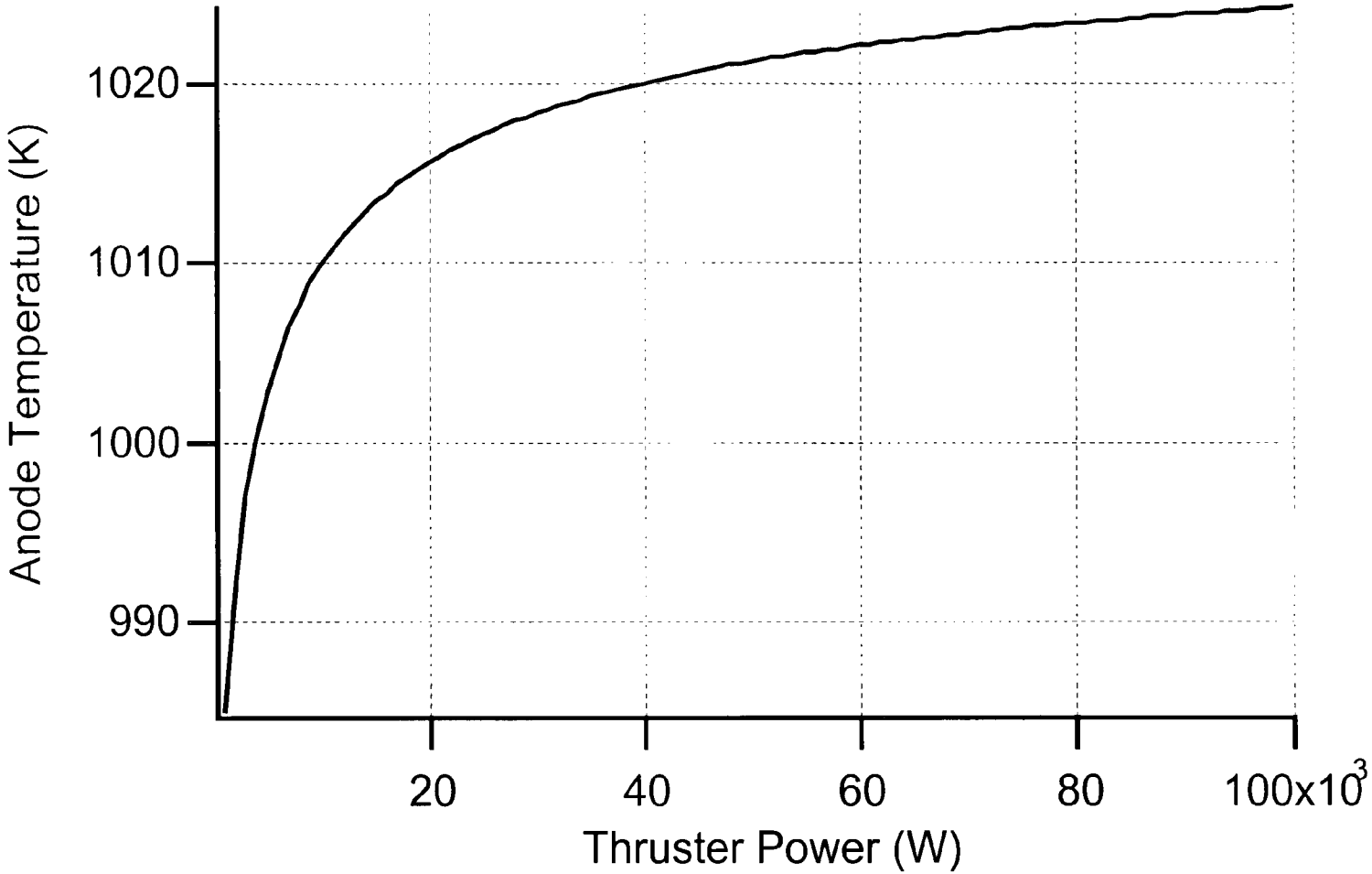
FIGS. 5–7 illustrate prophetic data calculated for an exemplary Hall thruster embodying the present invention, as described in Example 1.

With an estimate of the power dissipated in the anode, it is possible to predict the equilibrium anode temperature as a function of thruster power in a manner similar to Eqn. 2. However, for a vaporizing liquid metal anode, a term to account for the energy convected away from the anode due to the evaporated propellant 22 should be included. Taking the evaporation into consideration, the power balance to the anode is written as $$0.2P_T=\dot{m}[\Delta h_{vap}+C_p(T_{boil}-T_{anode})]+\sigma\epsilon A T_{anode}^4+xP_T \qquad \text{Eqn. 3}$$

where $\Delta h_{vap}$ is the enthalpy of vaporization and $C_p$ is the propellant specific heat. The anode temperature can be numerically solved from Eqn. 3 for a given propellant species if the value of h is known. Fixing the thruster specific impulse at 2,000 seconds and assuming an efficiency, $\eta$=0.6, $\dot{m}$ can be found from Eqn. 1. FIG. 5 shows a calculation of equilibrium anode temperature for a bismuth Hall thruster as a function of thruster power (size).

Comparing FIG. 5 with Table 1, it can be seen that the equilibrium anode temperature in a bismuth Hall thruster falls between the melting point (544 K) and the boiling point (1837 K), ensuring a single liquid phase.

Figure 6:
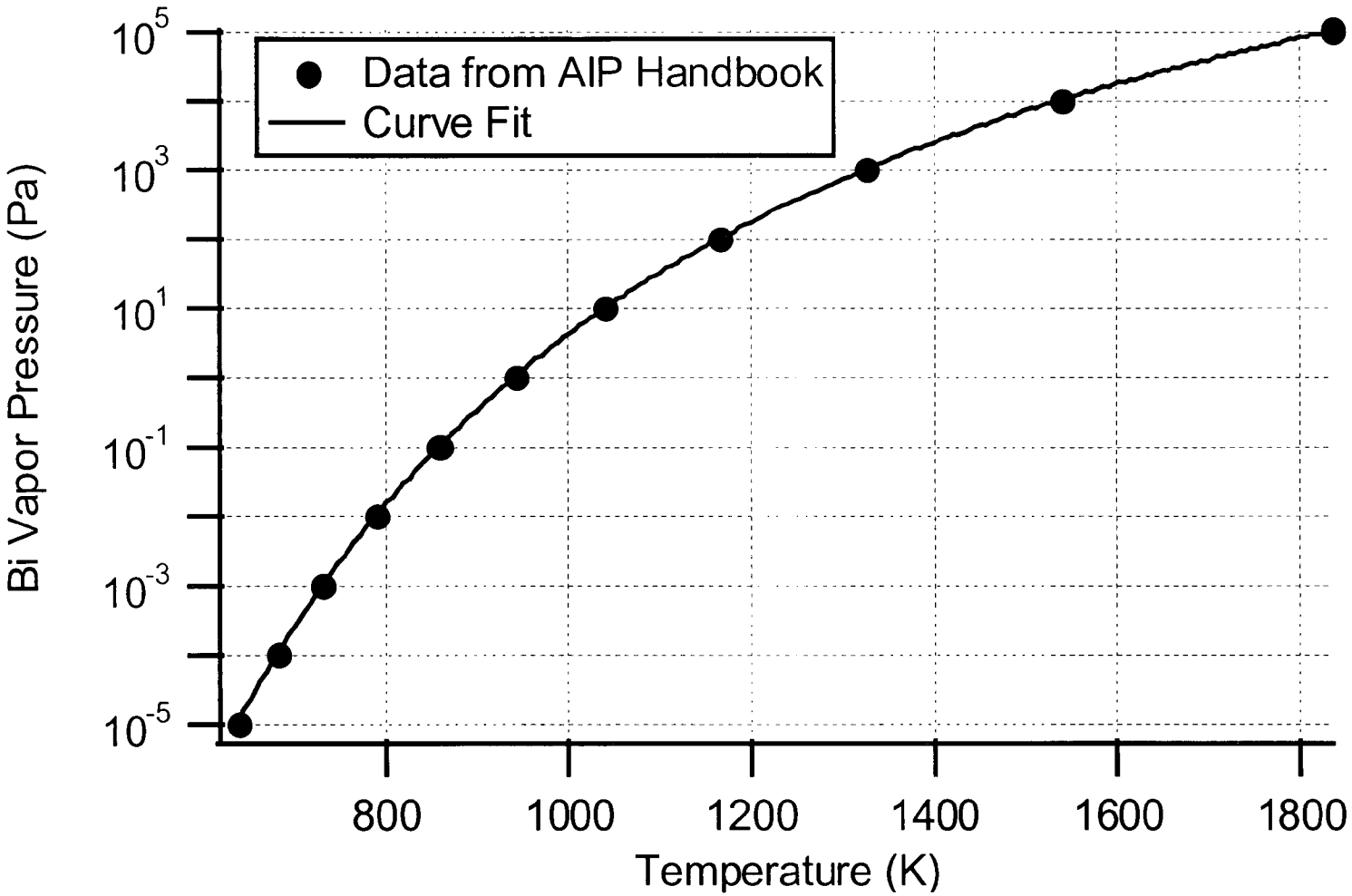

The propellant supply rate to the discharge, $\dot{m}$, in the proposed liquid metal system will be governed by the propellant vapor pressure at the equilibrium anode temperature, $P_v=P_v(T_{anode})$, and the escape area through which the propellant vapors 32 diffuse to the discharge chamber 18, $A_{vapor}$. For metallic species of interest, vapor pressure curves are readily available in the literature (see, for example, AIP Handbook). For example, FIG. 6 displays the equilibrium vapor pressure of molten bismuth as a function of temperature. A curve fit to these data for bismuth can be given as Eqn. 4, where A=13.317, B=−10,114, C=−0.86, $P_v$ is in Pascals and T is in Kelvin.

$$P_v = \log^{-1}\left[A + \frac{B}{T} + C\log T\right] \qquad \text{Eqn. 4}$$

The propellant supply rate is calculated by assuming that, within the anode, metal vapor exists at the equilibrium vapor pressure corresponding to the anode temperature. Kinetic theory can then be used to calculate the flux of vapor through the escape area, according to $$\frac{\dot{m}}{A_{vapor}} = \rho\sqrt{\frac{kT_{anode}}{2\pi m}} = \frac{mP_v(T_{anode})}{kT_{anode}}\sqrt{\frac{kT_{anode}}{2\pi m}} \quad \text{Eqn. 5}$$

or $$A_{vapor} = \frac{\dot{m}}{P_v(T_{anode})}\sqrt{\frac{2\pi kT_{anode}}{m}} \quad \text{Eqn. 6}$$

where m is the mass of a propellant atom, ρ is the density of the equilibrium vapor, and k is the Boltzmann constant.

Figure 7:
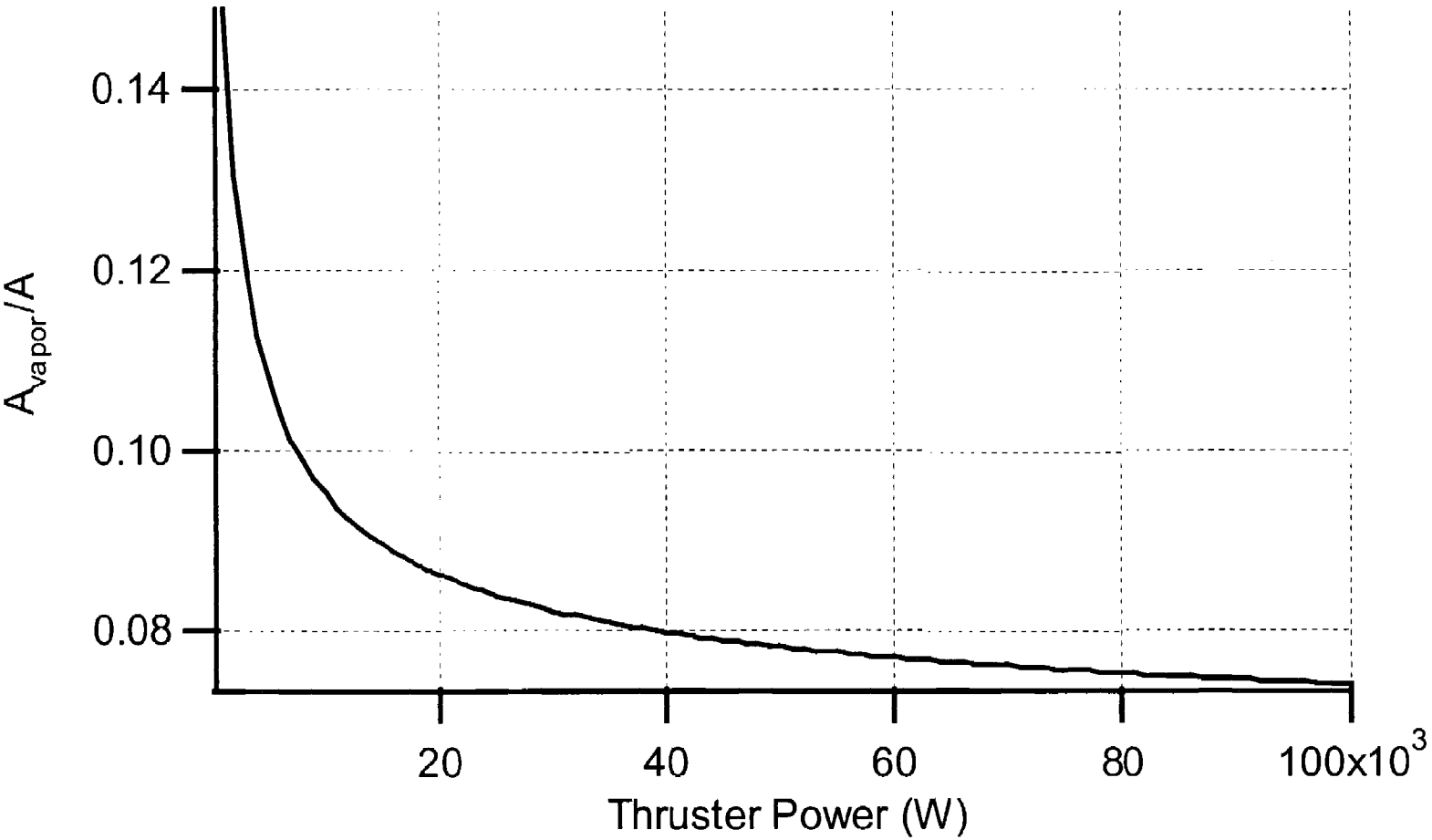

Using Eqn. 1 to define ṁ, Eqn. 3 to estimate the equilibrium anode temperature, Eqn. 4 to calculate the propellant vapor pressure, Eqn. 6 to determine the vapor escape area, and correlated historical Hall thruster data relating anode face area ($m^2$) to thruster power (W), it is possible to predict the fraction of the anode face area that must be open to permit adequate bismuth evaporation for a given thruster power. The open area fraction, $A_{vapor}/A$, is shown in FIG. 7 for a 2,000-sec-$I_{sp}$ bismuth Hall thruster operating at 60% efficiency. It is apparent from FIG. 7 that, depending upon thruster input power, between 7% and 14% of the total anode face area must be permeated with vapor escape passages. The open-area fraction could be achieved in numerous ways including drilling small holes in the anode or machining azimuthal or radial channels.

EXAMPLE 2

Example 1 describes a method that can be used to estimate the open area fraction of a liquid-metal vaporizing anode. Although the estimates prove the feasibility of the system, the propellant supply concept presented represents an unstable system. For instance, if the anode power deposition rate exceeds the 20% assumed in the analysis, the equilibrium anode temperature will increase and, hence, the propellant supply rate, ṁ, will increase. This increase in ṁ will cause an overall increase in $P_T$, which will further amplify the increase in anode temperature ad infinitum.

Figure 8:
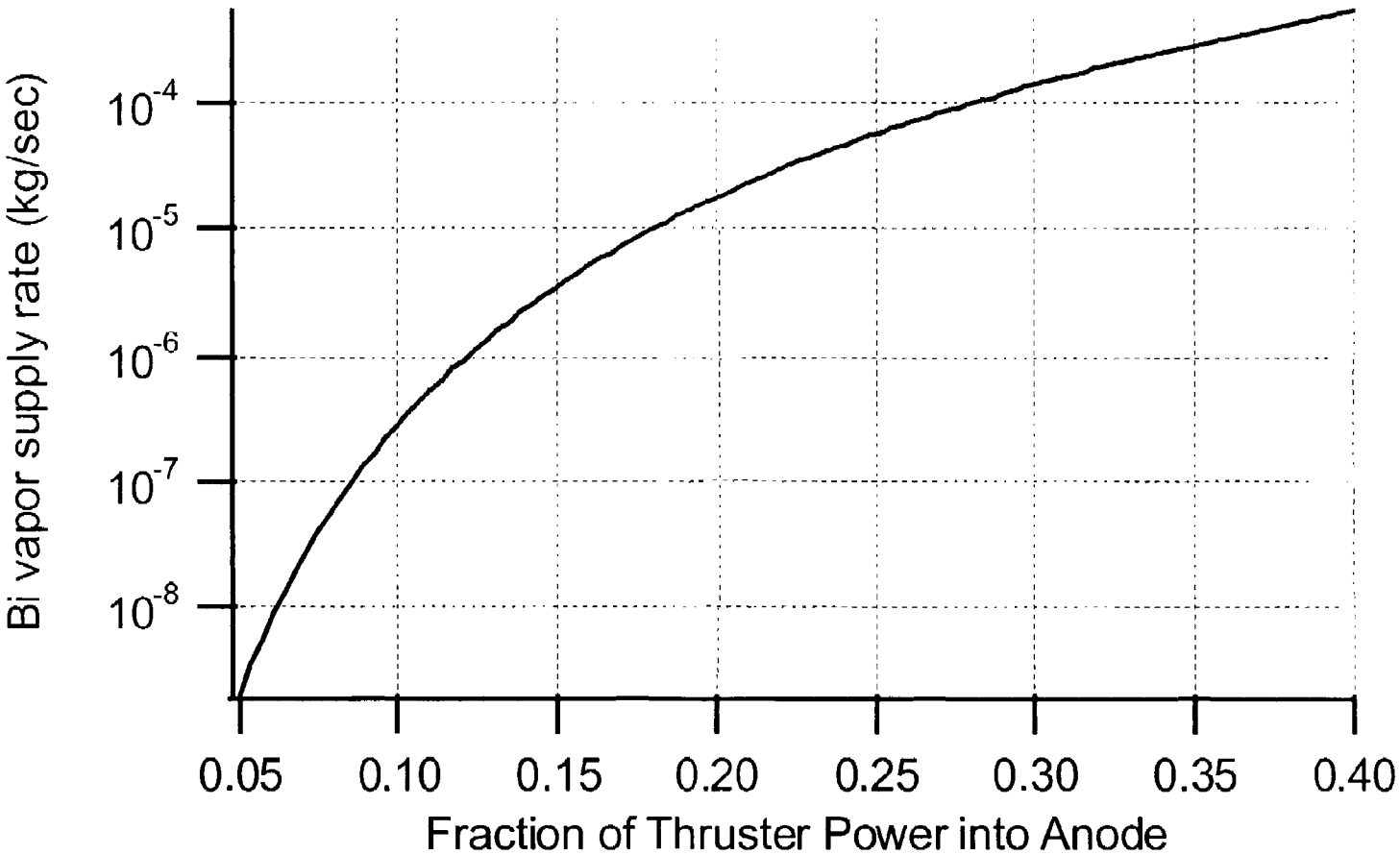
FIGS. 8–9 illustrate prophetic data calculated for an exemplary Hall thruster embodying the present invention, as described in Example 2.

The sensitivity of the propellant supply system described in Example 1 can be illustrated through a specific case. Consider a 10-kW bismuth Hall thruster at η=0.6 and $I_{sp}$=2,000 sec. Assuming an anode power deposition of $0.2P_T$ (2000 W), with the relative radiant and conduction losses from the datum of Example 1, allows calculation of the equilibrium anode temperature and, hence, the required $A_{vapor}$ to supply the correct mass flow rate (or propellant supply rate) of $\dot{m}=1.56\times10^{-5}$ kg/sec. If the power input to the anode is instead $0.21P_T$ (or 210 W), then the propellant supply rate through the fixed area $A_{vapor}$ increases to approximately $2\times10^{-5}$ kg/sec (see FIG. 8). Thus, a 5% change in the anode power deposition (200 W to 210 W) produces a nearly 30% change in ṁ. The sensitivity arises from the steep slope of the Bi vapor pressure curve as can be seen from comparing FIG. 6 with Eqn. 5.

It is instructive to quantify the sensitivity of ṁ as a function of anode power deposition. A measure of the sensitivity can be defined as the fractional change in ṁ per fractional change in anode power deposition according to $$S \equiv \frac{\Delta\dot{m}/\dot{m}}{\Delta q_{anode}/q_{anode}} = \frac{d\dot{m}}{dq_{anode}}\frac{q_{anode}}{\dot{m}}. \quad \text{Eqn. 7}$$

Figure 9:
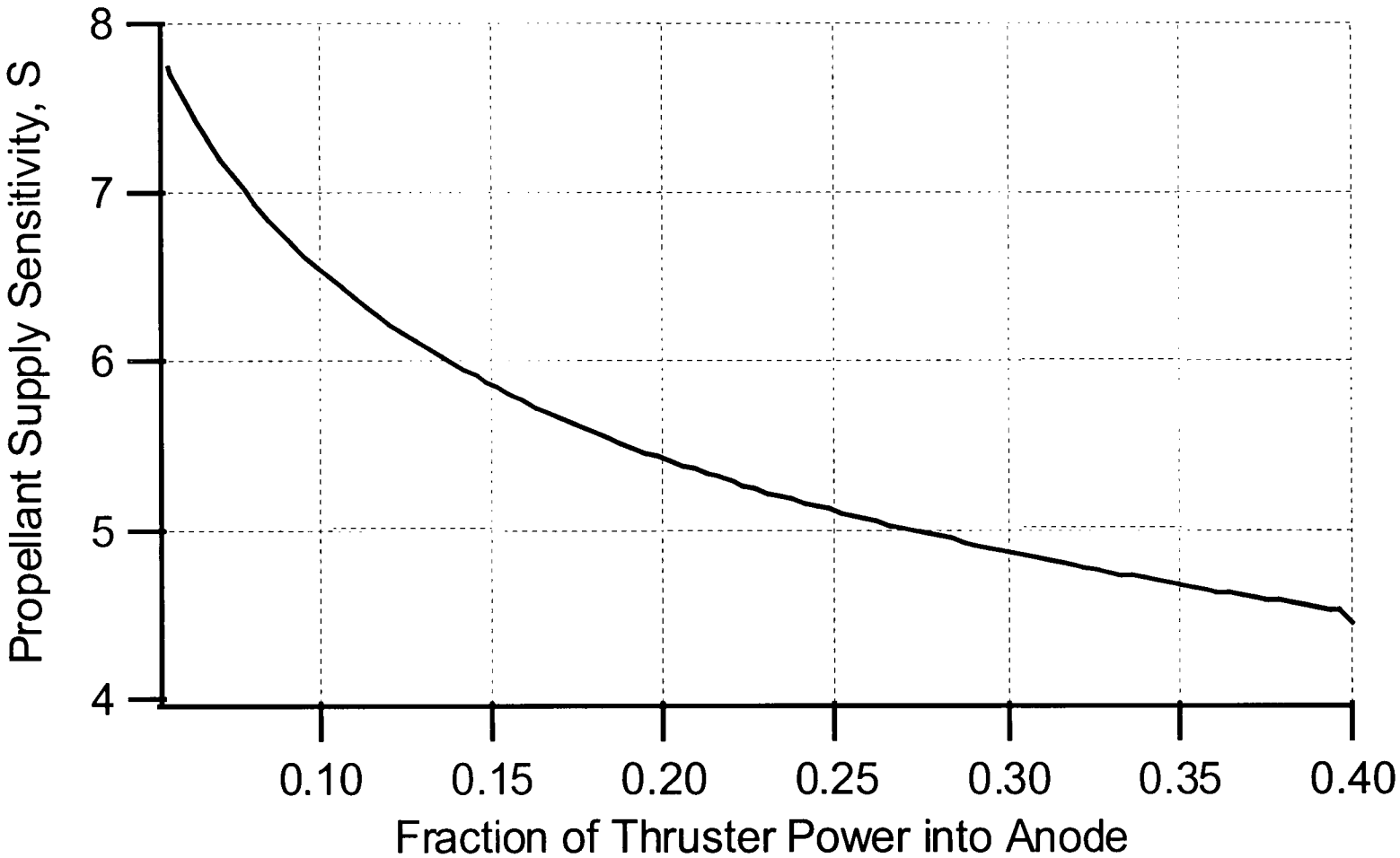

For the illustrative 10-kW case, it is possible to examine the propellant supply sensitivity as defined by Eqn. 7 as a function of thruster power deposition into the anode. FIG. 9 shows a plot of sensitivity, S, vs. fraction of $P_T$. The sensitivity ratio varies between about 5.8 and 5.2 over the expected range of anode power deposition (15% to 25%). It should be noted that the sensitivity is rather constant within this range.

Various features and aspects of the invention are set forth in the following claims.

I claim:

1. A thruster for use with an external power supply, the thruster comprising:

a propellant that exists in a non-gaseous state at standard temperature and pressure, the propellant having a melting point $T_m$, and a boiling point $T_b$;

a plasma comprising ionized propellant vapors;

a reservoir adapted to house the propellant in a non-gaseous state, the reservoir heated by the plasma; and at least one electrode positioned to intercept a fraction of the plasma to control heat input to the reservoir to maintain the temperature of the propellant between $T_m$ and $T_b$.

2. The thruster set forth in claim 1, wherein the propellant comprises a metal.

3. The thruster set forth in claim 1, wherein the propellant comprises at least one of bismuth, mercury, cesium, cadmium, iodine, tin, indium, lithium and germanium.

4. The thruster set forth in claim 1, wherein the propellant exists in a solid state at standard temperature and pressure.

5. The thruster set forth in claim 1, wherein the amount of power from the external power supply deposited into the reservoir is approximately 20% of the total power supplied to the thruster.

6. The thruster set forth in claim 1, wherein the amount of power from the external power supply deposited into the reservoir ranges from approximately 15% to approximately 25% of the total power supplied to the thruster.

7. The thruster set forth in claim 1, wherein the reservoir comprises an anode in an electric circuit, and further comprising:

a body having an axial direction and a radial direction;

at least one passage in the reservoir to allow propellant vapors to escape the reservoir;

a cathode positioned to emit electrons downstream of the body to create a substantially axial electric field with respect to the body, the electrons adapted to ionize the propellant vapors that have escaped the reservoir; and magnetic poles arranged to create a radial magnetic field that interacts with the axial electric field to produce a current of ionized propellant vapors according to the Hall effect.

8. The thruster set forth in claim 1, wherein the at least one electrode is positioned downstream of the reservoir to control at least one of the temperature of the reservoir and the evaporation rate of the propellant.

9. The thruster set forth in claim 1, wherein the reservoir comprises an anode.

10. The thruster set forth in claim 9, wherein the at least one electrode is positioned downstream of the anode to form a segmented anode comprising the at least one electrode and the anode.

11. The thruster set forth in claim 10, wherein the anode and the at least one electrode are thermally isolated from one another.

12. The thruster set forth in claim 10, wherein the anode and the at least one electrode are separated by a potential difference.

13. The thruster set forth in claim 9, wherein:

the plasma further comprises electrons; and the at least one electrode is positioned downstream of the anode to attract the electrons and divert the electrons to control heat input to the reservoir.

14. A thruster comprising:

a propellant that exists in a non-gaseous state at standard temperature and pressure;

an anode having a temperature and adapted to house the propellant in a liquid state;

at least one passage in an outer wall of the anode to allow propellant vapors to diffuse outwardly of the anode at a propellant supply rate;

an electron source positioned to ionize diffused propellant vapors; and at least one electrode positioned downstream of the anode to attract a fraction of electrons from the electron source and divert the electrons to control at least one of the temperature of the anode and the propellant supply rate.

15. The thruster set forth in claim 14, wherein the propellant comprises at least one of bismuth, mercury, cesium, cadmium, iodine, tin, indium, lithium and germanium.

16. The thruster set forth in claim 14, wherein the propellant comprises a metal.

17. The thruster set forth in claim 14, wherein the propellant exists in the solid state at standard temperature and pressure.

18. The thruster set forth in claim 14, further comprising a thermal insulator positioned to thermally isolate the anode and the at least one electrode.

19. The thruster set forth in claim 14, further comprising a voltage differential applied between the anode and the at least one electrode to cause electrons to move from the at least one electrode to the anode.

20. The thruster set forth in claim 14, further comprising:

a thruster body having a generally cylindrical shape with an axial direction and a radial direction;

an electric field established between the electron source and the anode, the electric field being directed substantially axially with respect to the thruster body, and magnetic poles positioned to create a radial magnetic field that interacts with the electric field to cause the ionized propellant vapors to move generally downstream in the thruster according to the Hall effect.

21. The thruster set forth in claim 14, wherein the anode is maintained at a temperature above the melting temperature of the propellant and below the boiling temperature of the propellant.

22. A method for producing a thrust in a thruster having an external power supply, the method comprising:

providing a propellant that exists in a non-gaseous state at standard temperature and pressure, the propellant having a melting temperature $T_m$ and a boiling temperature $T_b$;

providing a reservoir to house the propellant in a non-gaseous state;

vaporizing the propellant to form propellant vapors;

ionizing the propellant vapors to form a plasma comprising ionized propellant vapors;

heating the reservoir with the plasma; and maintaining the temperature of the propellant between $T_m$ and $T_b$ controlling power input from the external power supply and heat input from the plasma.

23. The method set forth in claim 22, wherein the propellant comprises at least one of bismuth, mercury, cesium, cadmium, iodine, tin, indium, lithium and germanium.

24. The method set forth in claim 22, wherein the propellant exists in a solid state at standard temperature and pressure.

25. The method set forth in claim 22, wherein the reservoir comprises an anode, and further comprising providing at least one electrode positioned downstream of the anode.

26. The method set forth in claim 25, further comprising applying a voltage differential between the anode and the at least one electrode.

27. The method set forth in claim 25, wherein ionizing the propellant vapors includes bombarding the propellant vapors with electrons from an electron source to produce more electrons, and further comprising:

attracting a fraction of the electrons with the at least one electrode;

applying a voltage differential between the anode and the at least one electrode; and selectively diverting the fraction of electrons with the at least one electrode to control the amount of power deposited into the anode.

28. The method set forth in claim 27, wherein an electric potential is established between the electron source and the anode, and further comprising:

controlling the electric potential between the electron source and the anode; and controlling the voltage differential between the anode and the at least one electrode.

29. The method set forth in claim 25, wherein ionizing the propellant vapors includes bombarding the propellant vapors with electrons from an electron source to produce more electrons, and wherein controlling power input from the external power supply and heat input from the plasma includes attracting a fraction of the electrons to the at least one electrode.

30. The method set forth in claim 22, further comprising:

establishing an electric field to cause the plasma to flow;

establishing a magnetic field normal to the electric field that interacts with the electric field to cause the plasma to flow according to the Hall effect.

* * * * *